US006384521B1

(12) United States Patent
Keim et al.

(10) Patent No.: US 6,384,521 B1
(45) Date of Patent: May 7, 2002

(54) ELECTRIC LAMP WITH A COMPARATIVELY ROBUST LAMP CAP

(75) Inventors: Peter C. Keim; Hendricus J. Te Loo, both of Middelburg (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/337,848

(22) Filed: Jun. 21, 1999

(30) Foreign Application Priority Data

Jun. 22, 1998 (EP) ..... 98202067

(51) Int. Cl.[7] ..... H01J 5/48; H01J 5/50

(52) U.S. Cl. ..... 313/318.04; 313/318.01; 313/318.09; 313/25

(58) Field of Search ..... 313/318.04, 318.01, 313/318.09, 25

(56) References Cited

U.S. PATENT DOCUMENTS 4,044,277 A * 8/1977 Komyati ..... 313/318.04
4,489,252 A * 12/1984 Eckhardt ..... 313/318.07
4,779,021 A * 10/1988 Haraden ..... 313/25
5,008,587 A * 4/1991 Borgis ..... 313/318.01
5,039,905 A * 8/1991 Essers et al. ..... 313/318.01
5,187,407 A 2/1993 Borgis et al. ..... 313/318
5,308,273 A * 5/1994 Meade et al. ..... 445/27
5,367,219 A * 11/1994 Friederichs ..... 313/113
5,568,009 A * 10/1996 Ghandi ..... 313/318.01

FOREIGN PATENT DOCUMENTS

EP 0480503 A1 * 9/1991
EP 0516231 A2 * 5/1992
EP 0583034 A1 * 8/1993

* cited by examiner

*Primary Examiner*—Vip Patel
*Assistant Examiner*—Kevin Quarterman
(74) *Attorney, Agent, or Firm*—Dicran Halajian

(57) ABSTRACT

The electric lamp is provided with a cap (3) having a metal shell (8). The shell (8) comprises a cylindrical part (44) which is coupled to a conical part (42) via a rounding (43). By choosing the angle β between the second part (52) of the conical part (42) and the cylindrical part (44) smaller than the angle αbetween the first part (51) of the conical part (42) and the cylindrical part (44), the axial strength of the metal shell (8) is increased.

10 Claims, 3 Drawing Sheets

ELECTRIC LAMP WITH A COMPARATIVELY ROBUST LAMP CAP

BACKGROUND OF THE INVENTION

The invention relates to an electric lamp comprising a lamp vessel in which a light source is arranged;

a lamp cap connected to the lamp vessel and provided with electrical contacts;

current supply conductors connected to the light source and to respective contacts of the lamp cap;

which lamp cap comprises a metal shell having a cylindrical portion connected to a conical portion, the cylindrical portion enclosing an angle with the conical portion.

The invention further relates to a lamp cap for use in the lamp.

Such a lamp is generally known and is described in, for example, U.S. Pat. No. 5,187,407. The lamp cap of the lamp may be of the Edison type. The lamp cap comprises the metal shell, which forms a first electrical contact, and a base portion of insulating material, for example of glass, such as vitrite glass, which base portion supports a metal disc which forms a second electrical contact.

The cylindrical shell portion and the metal disc of the known lamp are interconnected by the insulating material. The cylindrical portion is connected to a threaded portion, via a bend and the conical portion of the shell, and encloses an angle with the conical portion. By the angle enclosed by the cylindrical portion and the conical portion is meant the angle enclosed by the relevant generating lines. When the lamp is placed in a lampholder, a bottom contact member of the lampholder comes into contact with the second electrical contact, which as a result is exposed to a compression force in axial direction, i.e. parallel to the direction from the second electrical contact to the light source. The axial compression force is subject to a lower limit so as to realize a good contacting between the bottom contact member and the second electrical contact throughout lamp life.

It may happen during use of the known lamp that the lower limit of the axial compression force is amply exceeded. This increases the risk of the conical portion of the shell becoming deformed, for example in that it is made to buckle up over the insulating material, in which case the lamp cap is damaged and the contacting between the base contact member and the second electrical contact is absent, so that lamp life is prematurely terminated.

It is a disadvantage of the known lamp that its cost price is comparatively high because comparatively much material is required for the shell if the latter is to be made sufficiently strong, i.e. for withstanding axial compression forces at or somewhat above the lower limit.

SUMMARY OF THE INVENTION

It is an object of the invention to provide an electric lamp of a kind as described in the opening paragraph in which the above disadvantage is counteracted.

This object is achieved in that the conical portion comprises a first portion and a second portion bording the cylindrical portion which enclose respective angles with the cylindrical portion, an angle β between the second portion and the cylindrical portion being smaller than an angle α between the first portion and the cylindrical portion. The risk of a forced inward buckling deformation of the cylindrical portion is considerably reduced thereby. Instead of buckling inwards, the cylindrical portion can bolster itself against the insulating body, whereby a comparatively high axial strength of the shell is achieved.

Experiments have shown that the risk of an inward buckling of the cylindrical portion substantially does not exist when the angle β between the second portion and the cylindrical portion is no more than 35°. The shape of the conical portion of the shell, with the angle β of at most 35°, renders it possible to realize a thinner shell compared with the present state of the art, without a substantial change in the strength in axial direction of the shell occurring.

In a favorable embodiment, the angle β between the second portion and the cylindrical portion is at most 5°. The production of the shell is comparatively simple then because the second part can be folded against the cylindrical part, which means that the production equipment does not need an accurate adjustment. The second portion will spring back slightly owing to the elasticity of the material, but the angle β enclosed by the second portion and the cylindrical portion after that will then be 5° at the most.

It is favorable for lamp caps of the Edison type when the shell has not only the adapted shape of the conical portion but also a threaded portion which is provided with, for example, two or more longitudinal grooves, i.e. elongate depressions extending in axial direction towards the cylindrical portion. These longitudinal grooves give the shell a certain degree of stiffness in axial direction and reinforce the threaded portion of the shell. The use of a metal, for example aluminum, of a smaller thickness is then possible for, for example, an E27 lamp cap without an accompanying substantial change in strength in the axial direction of the shell.

DETAILED DESCRIPTION OF THE PREFERRED EMBODIMENTS

Figure 1:
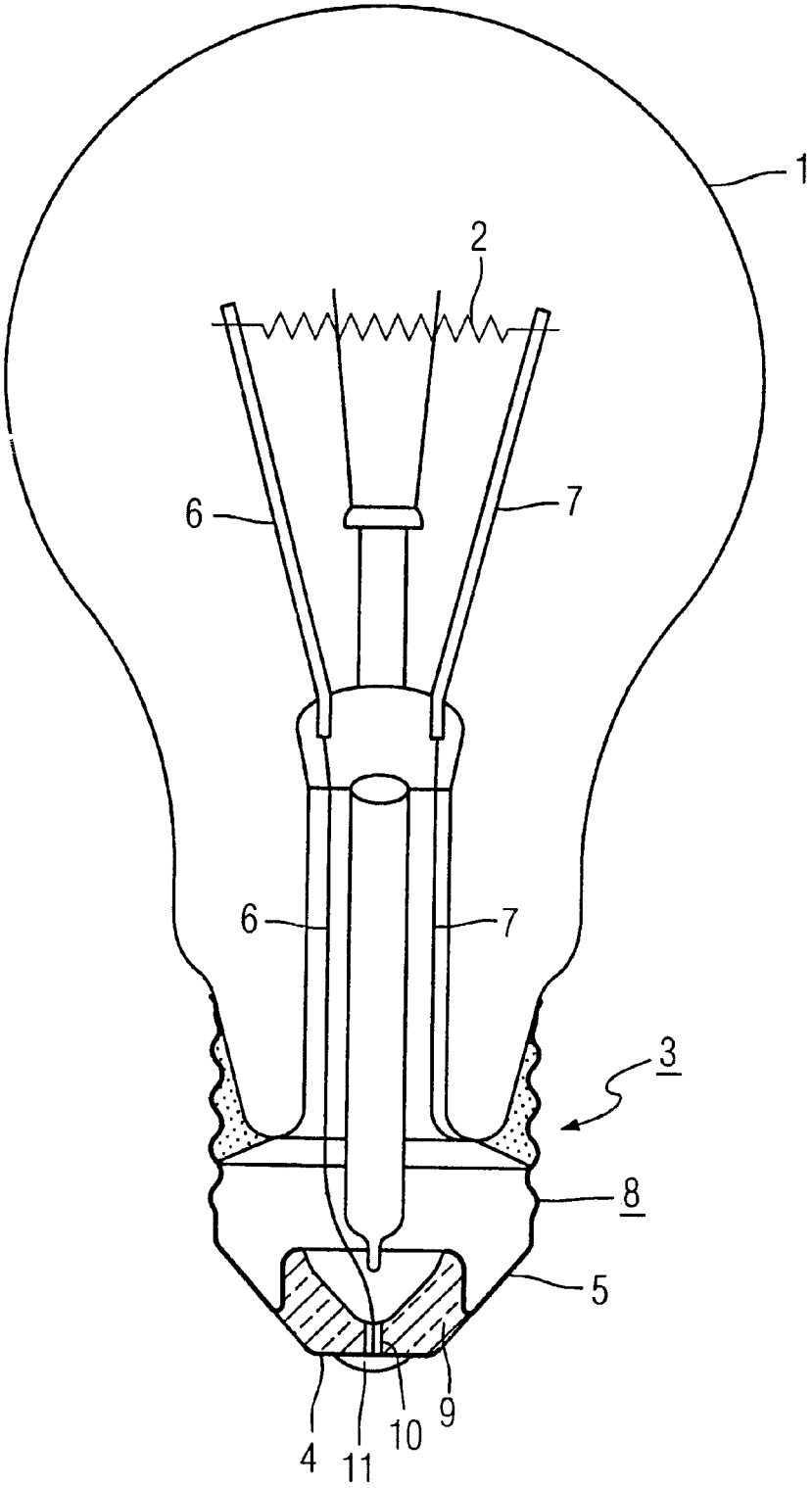
FIG. 1 shows a first embodiment in side elevation with the lamp cap according to the invention in longitudinal sectional view.

In the FIGS. 1, 2, 3 and 4, corresponding components have been given the same reference numerals. In FIG. 1, the lamp has a lamp vessel 1 in which a light source 2 is positioned, an incandescent body in the lamp drawn. A lamp cap 3, an Edison lamp cap in the Figure, is connected to the lamp vessel 1. Current supply conductors 6, 7 are connected to the light source 2 and to respective contacts 4, 5 of the lamp cap 3. The lamp cap has a metal shell 8 which forms the first electrical contact 5, and a base 9 of insulating material, for example of glass, such as vitrite glass. The base 9 supports a metal disc which forms the second electrical contact 4. A current supply conductor 6 issues through an opening 10 in the base 9 and in the metal disc to the exterior, where it is fastened to the metal disc, for example welded or, for example, fastened with solder 11.

Figure 2:
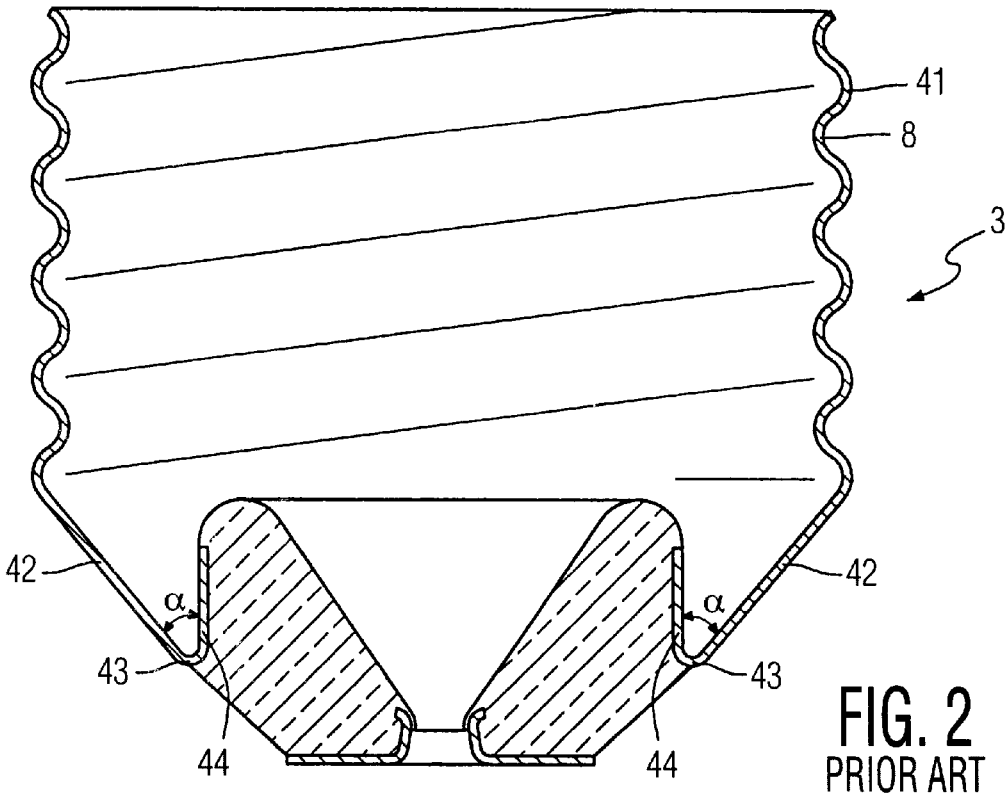
FIG. 2 PRIOR ART
FIG. 2 shows a detail of a known lamp cap in longitudinal sectional view.

In FIG. 2, the shell 8 of the lamp cap 3 of the known lamp has a screwthread 41 which is joined to a cylindrical portion 44 via a conical portion 42 and a bend 43. The conical portion 42 encloses an angle a of approximately 45° with the cylindrical portion 44. The metal used for the shell has a thickness of 0.25 mm.

Figure 3:
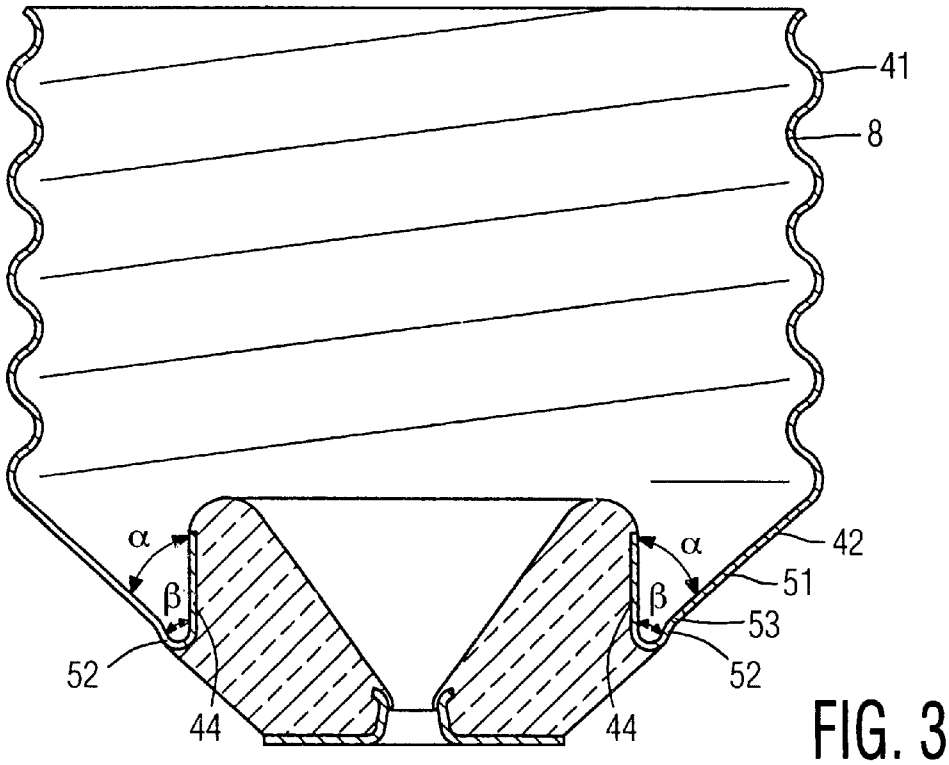
FIG. 3 shows a detail of the lamp cap of the lamp of FIG. 1 in longitudinal sectional view.

In FIG. 3, the conical portion 42 of the lamp according to the invention comprises a first portion 51 and a second portion 52 bordering the cylindrical portion 44 which merge into one another, at the area of a bend 53 in the drawing, but the first 51 and second portion 52 may alternatively merge into one another, for example, via a gradual curvature. The first portion 51 and the second portion 52 enclose an angle a of approximately 45° and an angle β of approximately 30°, respectively, with the cylindrical portion 44. The metal used for the shell has a thickness of 0.22 mm.

Figure 4:
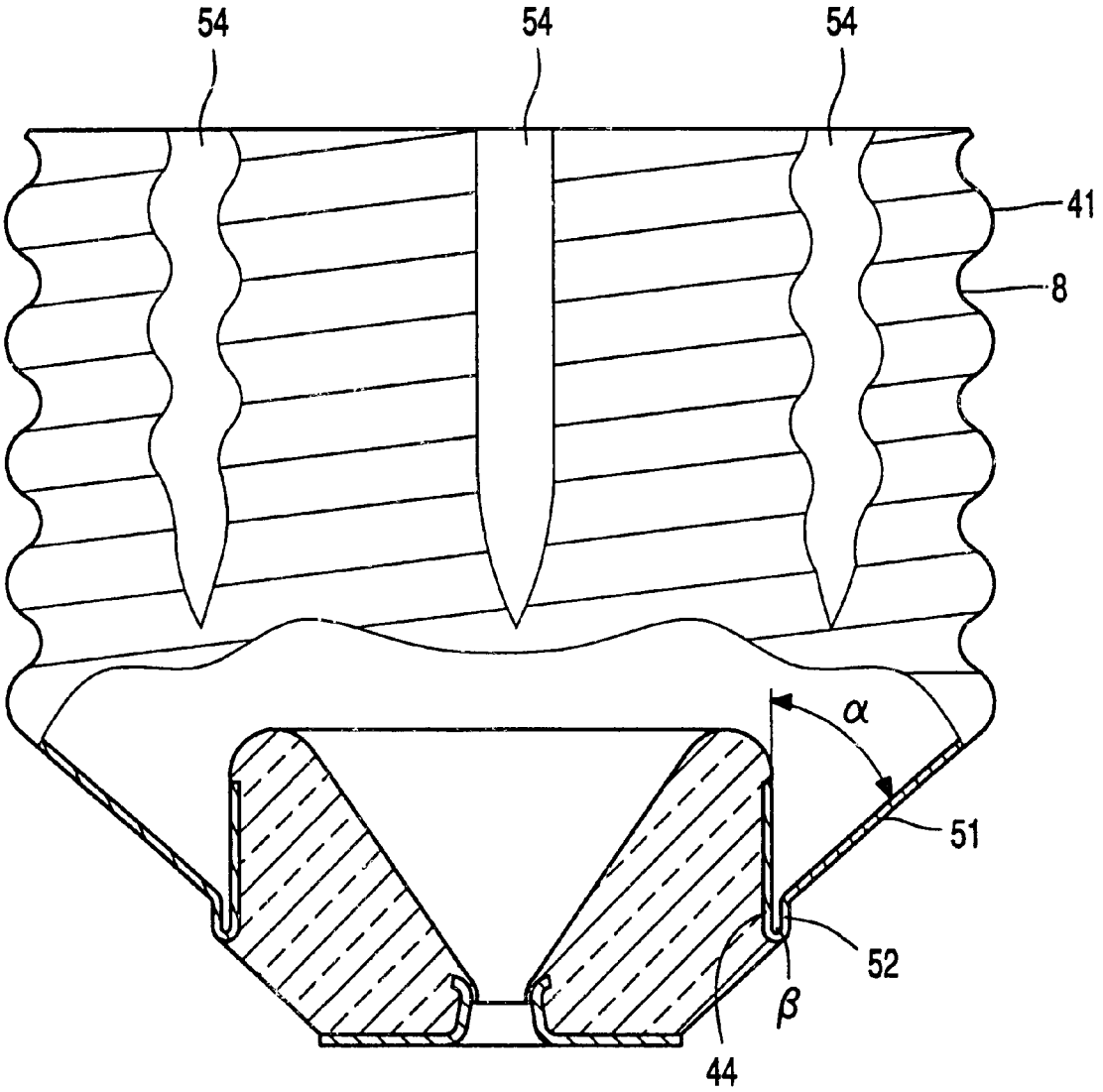
FIG. 4 shows a detail of a second embodiment of a lamp cap according to the invention, partly broken away.

In FIG. 4, the first portion 51 encloses an angle a of approximately 48° with the cylindrical portion 44. The second portion 52 is at an angle β of 1°, i.e. practically parallel to the cylindrical portion 44. The shell 8 has longitudinal grooves 54 in its threaded portion 41, running at least substantially in axial direction. The metal used for the shell has a thickness of 0.22 mm.

What is claimed is:

1. An electric lamp comprising a lamp vessel in which a light source is arranged;

a lamp cap connected to the lamp vessel and provided with electrical contacts;

current supply conductors connected to the light source and to respective contacts of the lamp cap;

which lamp cap comprises a metal shell having a cylindrical portion connected to a conical portion, wherein the conical portion comprises a first portion and a second portion bordering the cylindrical portion which enclose respective angles α and β with the cylindrical portion, said angle β between the second portion and the cylindrical portion being greater than zero and smaller than said angle α.

2. An electric lamp as claimed in claim 1, wherein the second portion of the conical portion is folded against the cylindrical portion.

3. An electric lamp as claimed in claim 1, wherein the angle β between the second portion and the cylindrical portion is at most 5°.

4. An electric lamp as claimed in claim 1, wherein the angle β between the second portion and the cylindrical portion is at most 35°.

5. An electric lamp as claimed in claim 1, 4 or 3, wherein the shell has a threaded portion which is provided with longitudinal grooves.

6. A lamp cap comprising a metal shell;

which metal shell comprises a cylindrical portion connected to a conical portion, wherein the conical portion comprises a first portion and a second portion bordering the cylindrical portion which enclose respective angles α and β with the cylindrical portion, said angle β being greater than zero and smaller than said angle α.

7. A lamp cap as claimed in claim 6, wherein the angle β between the second portion and the cylindrical portion is at most 5°.

8. A lamp cap as claimed in claim 6 wherein the shell has a threaded portion which is provided with longitudinal grooves.

9. A lamp cap as claimed in claim 6, wherein the angle β between the second portion and the cylindrical portion is at most 35°.

10. A lamp cap as claimed in claim 6, wherein the second portion of the conical portion of the metal shell is folded against the cylindrical portion.

* * * * *